US011680560B2

(12) United States Patent
Wolf

(10) Patent No.: US 11,680,560 B2
(45) Date of Patent: Jun. 20, 2023

(54) INTERNALLY COOLED INLINE DRIVE COMPRESSOR

(71) Applicant: Wayne A Wolf, San Marcos, TX (US)

(72) Inventor: Wayne A Wolf, San Marcos, TX (US)

( * ) Notice: Subject to any disclaimer, the term of this patent is extended or adjusted under 35 U.S.C. 154(b) by 0 days.

(21) Appl. No.: 17/401,466

(22) Filed: Aug. 13, 2021

(65) Prior Publication Data

US 2021/0372388 A1 Dec. 2, 2021

Related U.S. Application Data

(62) Division of application No. 15/895,366, filed on Feb. 13, 2018, now Pat. No. 11,118,578.

(60) Provisional application No. 62/459,549, filed on Feb. 15, 2017.

(51) Int. Cl.

| | |
|---|---|
| ***F04B 39/06*** | (2006.01) |
| ***F04B 25/02*** | (2006.01) |
| ***F04B 49/22*** | (2006.01) |
| ***F04B 35/00*** | (2006.01) |
| ***F04B 27/00*** | (2006.01) |
| ***F04B 53/14*** | (2006.01) |
| ***F04B 39/10*** | (2006.01) |
| *F04B 39/08* | (2006.01) |

(52) U.S. Cl.

CPC ..... *F04B 39/06* (2013.01); *F04B 25/02* (2013.01); *F04B 27/005* (2013.01); *F04B 35/008* (2013.01); *F04B 49/22* (2013.01); *F04B 53/143* (2013.01); *F04B 39/08* (2013.01); *F04B 39/10* (2013.01)

(58) Field of Classification Search

CPC ..... F04B 25/005–02; F04B 27/005; F04B 35/008; F04B 39/06; F04B 39/10; F04B 41/06; F04B 49/12; F04B 49/22; F04B 53/143

See application file for complete search history.

(56) References Cited

U.S. PATENT DOCUMENTS

| | | | | | |
|---|---|---|---|---|---|
| 3,937,599 | A * | 2/1976 | Thureau | F04B 17/006 | 417/389 |
| 4,334,833 | A * | 6/1982 | Gozzi | F04B 9/115 | 417/469 |
| 4,478,556 | A * | 10/1984 | Gozzi | F04B 25/00 | 417/264 |
| 4,627,794 | A * | 12/1986 | Silva | F01L 23/00 | 417/225 |
| 4,761,118 | A * | 8/1988 | Zanarini | F04B 9/115 | 417/396 |
| 4,818,192 | A * | 4/1989 | Korthaus | F01P 3/02 | 417/372 |
| 6,062,828 | A * | 5/2000 | Townsend | F04B 17/00 | 417/397 |
| 6,210,131 | B1 * | 4/2001 | Whitehead | F04B 9/113 | 417/397 |

(Continued)

*Primary Examiner* — Alexander B Comley

(74) *Attorney, Agent, or Firm* — Brian K. Yost; Decker Jones, PC

(57) ABSTRACT

A hydraulically operated compressor has a fixed piston and a fixed compression or outer cylinder. A drive or intermediate cylinder is located between the piston and outer cylinder. A compression chamber is formed between the drive cylinder and the outer cylinder. Drive fluid is pumped into and released from an interior chamber in the drive cylinder to reciprocate the drive cylinder. The drive fluid also provides cooling to the interior of the compressor.

4 Claims, 6 Drawing Sheets

(56) References Cited

U.S. PATENT DOCUMENTS

| | | | | |
|---|---|---|---|---|
| 2011/0052430 | A1* | 3/2011 | Dehnen | F04B 39/064<br>417/410.1 |
| 2014/0093395 | A1* | 4/2014 | Leavy | F04B 35/008<br>417/26 |

* cited by examiner

INTERNALLY COOLED INLINE DRIVE COMPRESSOR

This application is a divisional application of U.S. patent application Ser. No. 15/895,366 filed Feb. 13, 2018, the contents of which is incorporated by reference herein in its entirety.

FIELD OF THE INVENTION

The present invention relates to compressors.

BACKGROUND OF THE INVENTION

In a cylindrical reciprocating compressor, a piston reciprocates inside of a cylinder. Existing designs of hydraulically driven, inline compressors use double-acting pistons connected by a shaft, with each piston reciprocating in a respective cylinder. As the piston decreases the volume of the cylinder, the working medium, typically a gas, is compressed. Compression generates heat. The heat of compression is expressed in the inside of the cylinder until adequate energy accumulates to conduct the energy through the outer walls of the cylinder dissipating in the surrounding medium. This condition results in a temperature gradient that is highest at the center of the cylinder and lowest at the outer walls.

Because gas expands as its temperature increases, the captured volume of the compressor cylinder will hold less absolute volume of gas the more heat is retained in the system. This phenomenon results in considerable inefficiency in the mechanical work of compressors of the current state of the art. Additionally, the compressors of the current state of the art use many moving parts, often operating at high rate of speed. These compressors rely on close tolerances and wet lubrication to operate and thus, require frequent maintenance and inspection and are costly to manufacture.

While compressors can operate on a variety of fluids, one fluid in particular holds promise. Wide spread deployment of hydrogen as a fuel source has been held back in no small part by the cost and complexity of the compression equipment to dispense the gas to the end user. The adiabatic heat of compression for hydrogen is very high which results in low compression efficiency especially at the high outlet pressures required in hydrogen fuel storage and transport. The low efficiency requires that the compressor be oversized for compressing hydrogen, as compared to most gases, making compression of hydrogen expensive in terms of energy and capital. This has restricted the use of hydrogen to a few centralized fueling stations, primarily as demonstration programs which operate without expectation of a profitable return.

It is desired to provide an efficiently cooled compressor.

SUMMARY OF THE INVENTION

An internally cooled inline compressor comprises a fixed piston with a channel therethrough. A fixed outer cylinder has a gas inlet and a gas outlet, with each of the gas inlet and the gas outlet having at least one one-way valve. An intermediate cylinder has a closed compression end and a side wall. The compression end and a portion of the side wall located between the piston and the outer cylinder. The compression end of the intermediate cylinder, the side wall and the outer cylinder form a compression chamber. The compression end of the intermediate cylinder, the side wall and the piston form a drive chamber. The drive chamber communicates with the channel. The intermediate cylinder is capable of reciprocating between the piston and the outer cylinder. A power source is connected to the channel, the power source alternately providing and discharging a drive fluid to the drive chamber to reciprocate the intermediate cylinder. A heat exchanger is alternately connected to the channel so that the drive fluid that is discharged from the drive chamber passes through the heat exchanger.

In accordance with one aspect, a first seal is between the piston and the intermediate cylinder. A second seal is between the intermediate cylinder and the outer cylinder, the second seal being isolated from the drive fluid by the intermediate cylinder.

In accordance with another aspect, the piston is a first piston, the outer cylinder is a first outer cylinder and the intermediate cylinder is a first intermediate cylinder. The compressor comprises a second fixed piston with a second channel therethrough, the second piston coupled to the first piston. The compressor has a second fixed outer cylinder with a respective gas inlet and gas outlet and with each of the respective gas inlet and gas outlet having at least one one-way valve. The second outer cylinder is coupled with the first outer cylinder. A second intermediate cylinder is coupled to the first intermediate cylinder. The second intermediate cylinder is located between the second piston and the second outer cylinder and forms a second compression chamber with the second outer cylinder, the second intermediate cylinder capable of reciprocating between the second piston and the second outer cylinder.

In accordance with another aspect, the compression chamber comprises a first compression chamber. The compressor further comprises a second compression chamber formed by the outer cylinder and the intermediate cylinder. The outer cylinder has a first inside diameter in the first compression chamber and a second inside diameter in the second compression chamber. The first inside diameter is larger than the second inside diameter. The intermediate cylinder has a first outside diameter in the first compression chamber and a second outside diameter in the second compression chamber. The first outside diameter is larger than the second outside diameter. A first inside seal is between the piston and the intermediate cylinder in the first compression chamber. A second inside seal is between the piston and the intermediate cylinder in the second compression chamber. A first outside seal is between the intermediate cylinder and the outside cylinder in the first compression chamber. A second outside seal is between the intermediate cylinder and the outside cylinder in the second compression chamber. The first and second outside seals are isolated from the drive fluid by the intermediate cylinder.

In accordance with another aspect, the channel in the piston is a first channel, further comprising a second channel in the piston. The first channel has a first opening located at a first position in the drive chamber. The second channel has a second opening located in the drive chamber. The second opening is located between the closed compression end and the first opening, wherein the drive fluid can be circulated inside the drive chamber.

In accordance with another aspect, a control system alternately provides and discharges drive fluid from the drive chamber. The control system comprises a valve that has an entry position for connecting the power source to channel and the drive chamber, and an exit position for connecting the drive chamber and the channel to the heat exchanger.

In accordance with another aspect, the control system further comprises a positional sensor for sensing the position of the intermediate cylinder. A controller is connected to the positional sensor, the controller is connected to the valve.

In accordance with another aspect, the piston is a first piston, the outer cylinder is a first outer cylinder and the intermediate cylinder is a first intermediate cylinder. The compressor further comprises a second fixed piston with a second channel therethrough. The second piston is coupled to the first piston. A second fixed outer cylinder has a respective gas inlet and gas outlet and with each of the respective gas inlet and gas outlet having at least one one-way valve. The second outer cylinder is coupled with the first outer cylinder. A second intermediate cylinder is coupled to the first intermediate cylinder. The second intermediate cylinder is located between the second piston and the second outer cylinder and forms a second compression chamber with the second outer cylinder. The second intermediate cylinder is capable of reciprocating between the second piston and the second outer cylinder. Each of the first and second compression chambers comprise first and second stages. Each of the respective first and second outer cylinders have a first inside diameter in the first stage and a second inside diameter in the second stage. The respective first inside diameter is larger than the respective second inside diameter. Each of the respective first and second intermediate cylinders have a first outside diameter in the first stage and a second outside diameter in the second stage. The respective first outside diameter is larger than the respective second outside diameter. For each of the first and second stages, a first inside seal is between the respective first and second pistons and the respective first and second intermediate cylinders. For each of the first and second stages, a second inside seal is between the respective first and second pistons and the respective first and second intermediate cylinders. For each of the first and second stages, a first outside seal is between the respective first and second intermediate cylinders and the respective first and second outside cylinders. For each of the first and second stages, a second outside seal is between the respective first and second intermediate cylinders and the respective first and second outside cylinders. The respective first and second outside seals are isolated from the drive fluid by the respective first and second intermediate cylinders.

In accordance with another aspect, the drive chamber is a first drive chamber, the second piston and the second intermediate cylinder form a second drive chamber. The compressor further comprises a control system that provides the drive fluid to the first chamber while allowing discharging of the drive fluid from the second drive chamber, and alternatively allows discharging of the drive fluid from the first chamber while providing the drive fluid to the second drive chamber.

A process for internally cooling an inline compressor, comprises providing a compression chamber between an outer cylinder and an intermediate cylinder and a drive chamber between the intermediate cylinder and a piston. Gas is admitted into the compression chamber. Drive fluid is pumped through the piston into the drive chamber to extend the intermediate cylinder and compress the compression chamber and the gas in the compression chamber. Heat from the compressed gas is allowed to transfer to the drive fluid and the compressed gas is allowed to exit the compression chamber. The withdrawal of the drive fluid is allowed from the drive chamber. The withdrawn drive fluid is passed through a heat exchanger to cool the drive fluid for reuse in extending the intermediate cylinder.

In accordance with one aspect, the drive fluid is circulated within the drive chamber by pumping the drive fluid into a first location in the drive chamber and withdrawing the drive fluid from a second location in the drive chamber. One of the first location or the second location is closer to a compression chamber end of the intermediate cylinder that the other of the first location or the second location.

In accordance with another aspect, the process further comprises the step of isolating the gas in the compression chamber from the drive fluid by the intermediate cylinder.

In accordance with another aspect, wherein the compression chamber is a first compression chamber, the outer cylinder is a first outer cylinder, the intermediate cylinder is a first intermediate cylinder, the drive chamber is a first drive chamber, the piston is a first piston. The process further comprises the steps of providing a second compression chamber between a second outer cylinder and a second intermediate cylinder and a second drive chamber between the second intermediate cylinder and a second piston. The step of admitting gas into the compression chamber further comprises the steps of admitting gas into the first compression chamber and allowing gas to exit the second compression chamber. The step of pumping drive fluid through the piston into the drive chamber to extend the intermediate cylinder further comprises the step of alternately pumping the drive fluid into the first drive chamber to extend the first intermediate cylinder and compressing the gas in the first compression chamber and retract the second intermediate cylinder by discharging the drive fluid from the second drive chamber, then pumping the drive fluid into the second drive chamber to extend the second intermediate cylinder, compress the gas in the second compression chamber and retract the first intermediate cylinder by discharging the drive fluid from the first drive chamber. Heat from the compressed gas in the first compression chamber is allowed to transfer to the drive fluid in the first drive chamber and allowing heat from the compressed gas in the second compression chamber to transfer to the drive fluid in the second drive chamber. While each of the first and second intermediate cylinders alternately retract, allowing the drive fluid to exit the first and second drive chambers and pass through the heat exchanger to cool the drive fluid.

In accordance with another aspect, the step of alternately pumping drive fluid further comprises the step of operating a valve to alternately connect the respective first and second drive chambers to a pressurized drive fluid source and the heat exchanger.

In accordance with another aspect, the position of at least one of the first and second intermediate cylinders is sensed. The valve is operated to extend the first and second intermediate cylinders to a less than full extension.

DESCRIPTION OF THE PREFERRED EMBODIMENT

A hydraulically operated compressor is provided that uses internal cooling to economically and efficiently compress a fluid. The compressor uses the same drive fluid to both compress the fluid by reciprocating the drive, or intermediate, cylinder and to cool the compressor. The drive fluid reciprocates the drive cylinder with respect to a piston; the drive cylinder also reciprocates relative to a compression, or outer, cylinder to compress the fluid. The drive fluid is circulated within the piston in order to more efficiently cool the compressor.

Because the compressor is cooled, it operates at a lower temperature, and can more efficiently compress gasses such as hydrogen.

The compressor utilizes a simple sealing arrangement which minimizes contamination of the compressed fluid with lubricant and which isolates the compressed fluid from the drive fluid. In addition, the arrangement allows for inexpensive manufacturing, thus lowering the overall cost of the compressor.

In multi-stage compressors, the drive fluid is circulated within the drive cylinder to more efficiently remove heat.

Various control systems are provided to control the reciprocation. One control system uses an electronic controller, while another uses a mechanical controller.

Figure 1:
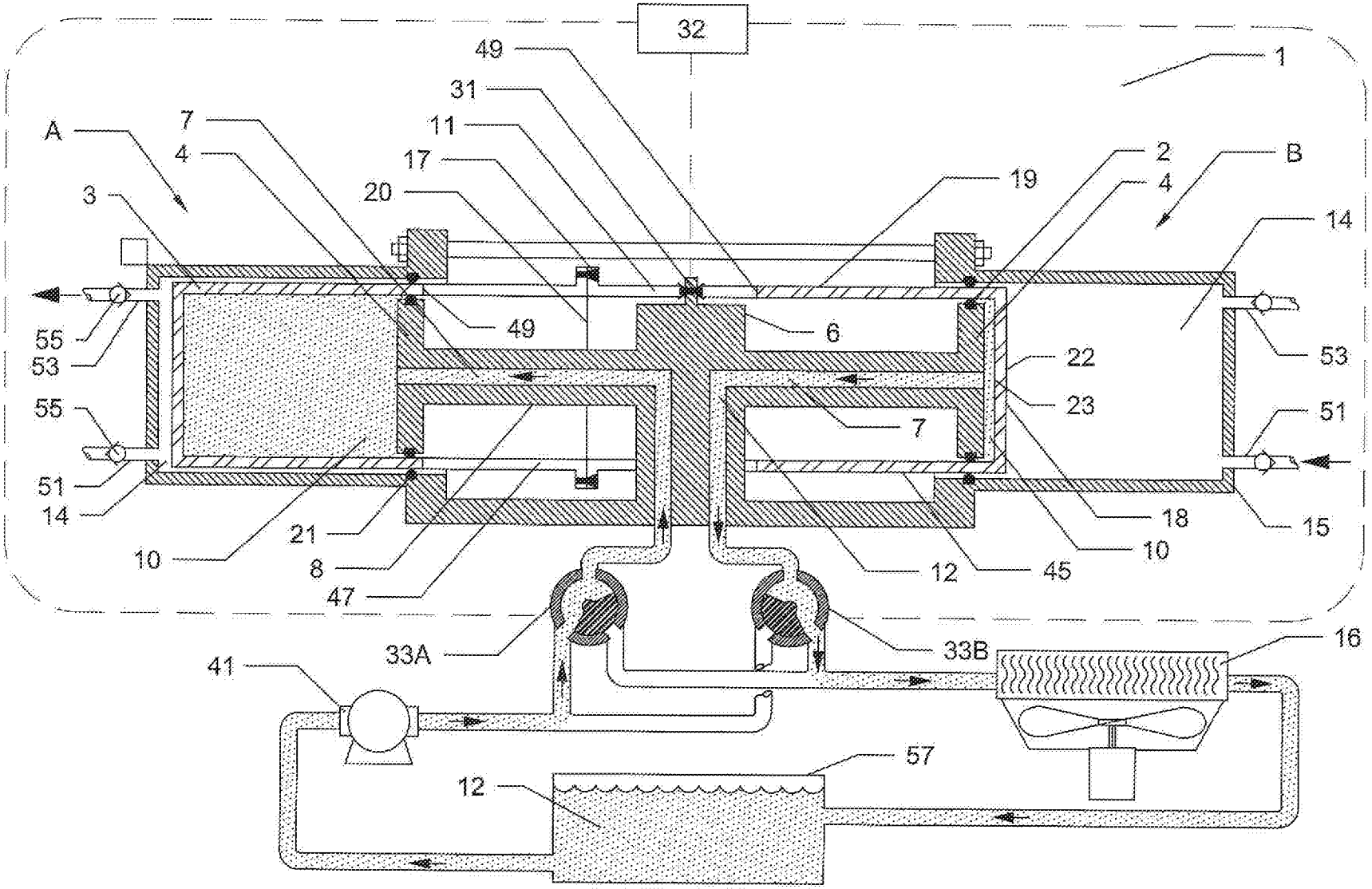
FIG. 1 is a side cross-sectional view of a single stage compressor of the present invention, in accordance with a preferred embodiment.
Figure 4:
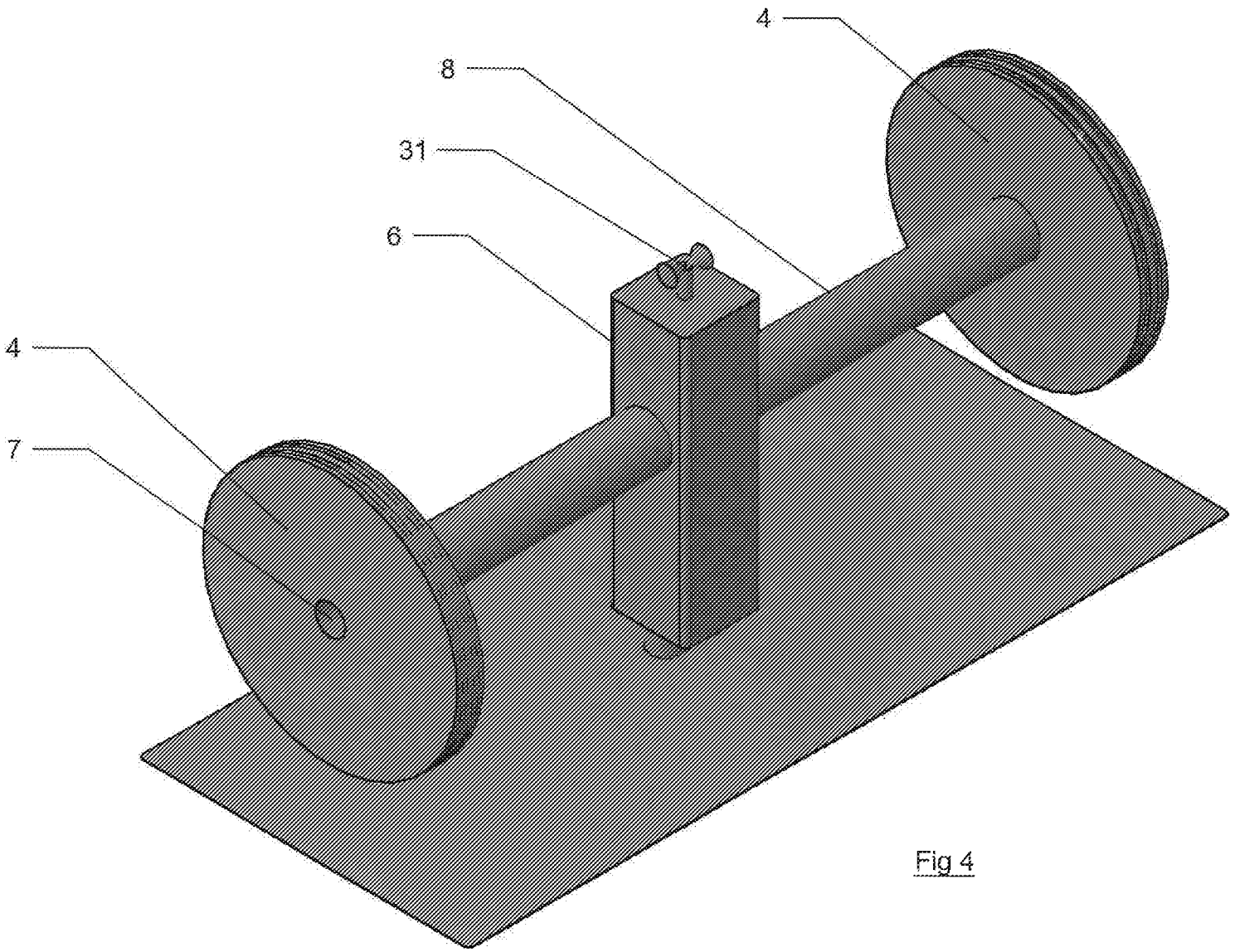
FIG. 4 is a perspective view of the support block of the compressor of FIGS. 2A and 2B.

FIG. 1 shows a single stage compressor. In general, the compressor is a dual cylinder, in-line compressor. The compressor has two sides, side A and side B. The compressor has a support block 6 that is fixed. The support block supports the other components and provides a mount or base for the pistons 4, one for each side A, B. Each piston 4 is a circular plate with a mounting support 8 that couples to the support block (see FIG. 4). Also coupled to the support block 6 are compression, or outer, cylinders 15, one for each side A, B. The compression cylinders are coupled with one another through the support block. The compression cylinders 15 each form a hollow tube, with one end open and receiving the respective piston and the other end closed. The pistons 4 and compression cylinder 15 are fixed.

Figure 3:
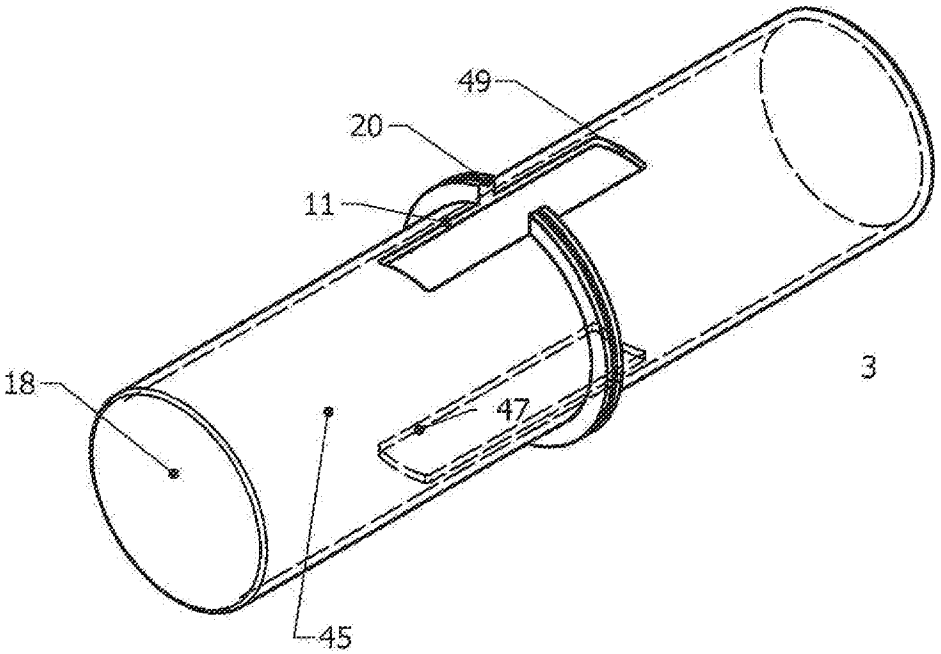
FIG. 3 is a perspective view of the intermediate cylinder of the compressor of FIGS. 2A and 2B.

Located inside of each compression cylinder is a drive, or intermediate, cylinder 3 (see FIGS. 1 and 3). The drive cylinders are joined together at junction 20, with fasteners 17, to form a drive cylinder assembly. Each drive cylinder is a hollow cylinder having an open end at junction 20 and a closed end 18. The drive cylinder has a side wall 45 that extends from the closed end 18 toward the open end. The drive cylinder 3 is located so that the closed end 18 and the side wall 45 are between the piston 4 and the compression cylinder 15. Seals 2, 21 are provided. Seals 2 are between the piston and the inside of the drive cylinder. Seals 2 are wetted by the drive fluid 12. Seals 21 are provided between the compression cylinder 15 and the drive cylinder 3, which seals are dry. When assembled, the drive cylinders 3 form a double acting piston arrangement inside of the compression cylinders. Each drive cylinder has an interior chamber, or drive chamber, 10, of which the piston 4 forms an end. Specifically, the end wall 18 and side wall 45 of the drive cylinder 3 and the piston 4 form the interior chamber 10.

The drive cylinder assembly has a center section that is not used for sealing. This center section has a lower slot 47 for receiving the support block 6. The center section also has, in the embodiment shown in FIG. 1, an upper slot 11 for a position sensor 31 (which is discussed in more detail below).

A compression chamber 14 is formed by each compression cylinder 15 and the respective drive cylinder 3. Specifically, each compression chamber is formed by the end wall 18 and the side wall 45 of the drive cylinder 3 and the compression cylinder 15. Each compression chamber 14 has an inlet 51 and an outlet 53. Each of the inlets and outlets have at least one one-way valve 55.

The support block 6, the piston mounting supports 8 and the pistons 4 have fluid channels 7 that communicate with the interior of each drive cylinder 3. Thus, there is a fluid channel for each side A, B and the two fluid channels 7 do not communicate with each other. A pump 41 is connected to each fluid channel 7 by way of a respective fluid control valve 33A, 33B one for each side A, B. Each fluid control valve 33A, 33B moves between an entry position and an exit position. In FIG. 1, valve 33A is shown in the entry position, while valve 33B is shown in the exit position.

The pump 41 forces hydraulic fluid 12 through a respective one of the valves 33A, 33B in the entry position and into the respective fluid channel 7 and to the interior chamber 10 of the respective drive cylinder 3. Then, hydraulic fluid exits the drive cylinder through the same valve, now in the exit position. The extension of the drive cylinder on one side (for example, side A) by the drive fluid causes the drive cylinder on the other side (side B) to retract and discharge the drive fluid from that side (side B). The exiting hydraulic fluid passes through a heat exchanger 16 and then into a reservoir 57, to be again passed through the pump.

In operation, referring to FIG. 1, the compression chamber 14 of side A is shown at full compression. The drive fluid 12, which can be hydraulic fluid, has been forced by the pump 41 through valve 33A and into the interior chamber 10 of the side A drive cylinder 3. For purposes of example, the fluid being compressed is hydrogen. The compressed hydrogen has largely exited the side A compression chamber through the respective outlet 53.

The compression of the hydrogen gas in chamber 14 of side A produces heat. Some of this heat passes through the side wall of the compression cylinder 15. Some of the heat is carried out by the compressed hydrogen. Heat removal from the compressed hydrogen and the side wall of the compression cylinder will be discussed in more detail below.

In general, the heat of compression is highest along the longitudinal axis of the compression chamber because this volume is furtherest away from the side wall of the compression chamber. In the compressor 1, this heat passes through the end wall 18 of the drive cylinder 3 and into the drive fluid 12 in the chamber 10. As shown by side B, much of the hot drive fluid has exited the chamber 10 and passed through valve 33B, which is in the exit position. The hot drive fluid 12 passes through the heat exchanger 16 where it is cooled. The heat exchanger 16 can be passive, or it can be provided with a fan, or a mechanical source of chilling. The cooled drive fluid then flows into the reservoir 57, from which the pump 41 draws.

Hydrogen has entered the compression chamber 14 of side B through the respective inlet 51. The fluid control valves change position, with valve 33A changing to the exit position and valve 33B moving to the entry position. The pump 41 pumps cooled drive fluid 12 into the chamber 10 of side B, causing the drive cylinder 3 to move and compress the gas in the Side B compression chamber 14. The heat from the compression is absorbed by the compression cylinder 15 side wall, by the compressed hydrogen gas and by the drive fluid 12 in the drive cylinder.

The pump 41 operates continuously, with the valves 33A, 33B alternating positions opposite to each other. Thus, while one valve is in the entry position, the other valve is in the exit position, and vice versa. The two drive cylinders 3 are coupled together. Thus, while the drive cylinder on side A is compressing hydrogen, the drive cylinder on side B is expanding the respective compression chamber and drawing in hydrogen therein through the inlet valve.

In this manner, the hydraulic fluid 12 serves as both the drive fluid to reciprocate the drive cylinders 3 and do the work of compression, while also cooling the drive cylinders 3 and piston 4. A separate cooling fluid is not needed.

The drive cylinders 3 are designed to prevent contamination of the hydrogen with the drive fluid. In the prior art, the drive fluid leaks through the seals and contaminates the hydrogen. With the compressor 1, the hydrogen in the compression chambers 14 is isolated from the drive fluid 12 by the drive cylinders 3. This eliminates the costly step of cleaning the compressed hydrogen of the drive fluid.

The drive cylinders 3 are also designed for ease of manufacturing. No grooving or other work for mounting seals in needed. Only the outside and inside diameters should be smooth to form seals. Each of the seals 2 is located in a groove or recess that is in the respective piston 4. The seals 2 contact the smooth inside surface of the drive cylinder 3. Each of the seals 21 is located in a groove or recess in the compression cylinder 15. The seals 21 contact the smooth outside surface of the drive cylinder 3.

Various controllers can be used to control valves 33A, 33B. In the embodiment of FIG. 1, an electronic controller 32 is used. The controller obtains information on the position of the drive cylinders 3 from the position sensor 31. The position sensor is located in the slot 11 of the drive cylinder assembly. The sensor 11 senses the ends 49 of the slot 11. The controller 32 thus knows when the drive cylinder assembly has reached the end of a reciprocation stroke in either direction and the controller changes the valves 33A, 33B to the other position (for example, from the entry position to the exit position). Due to the cycling of the valves 33A, 33B, the drive cylinder 3 assembly reciprocates back and forth for as long as the pump operates.

The stroke length of the drive cylinders 3 can be modulated in a controlled manner. If less than a full stroke length is desired, then the controller can cycle the valves 33A, 33B accordingly. For example, if a 90% stroke length is desired, then the controller cycles the valve when the drive cylinder extends 90% of its full stroke. Such a capability is useful for example where the compressor is operated for long periods of time and provides a higher than required output pressure. To operate more efficiently, the compressor stroke length can be less than full extension.

Figure 5:
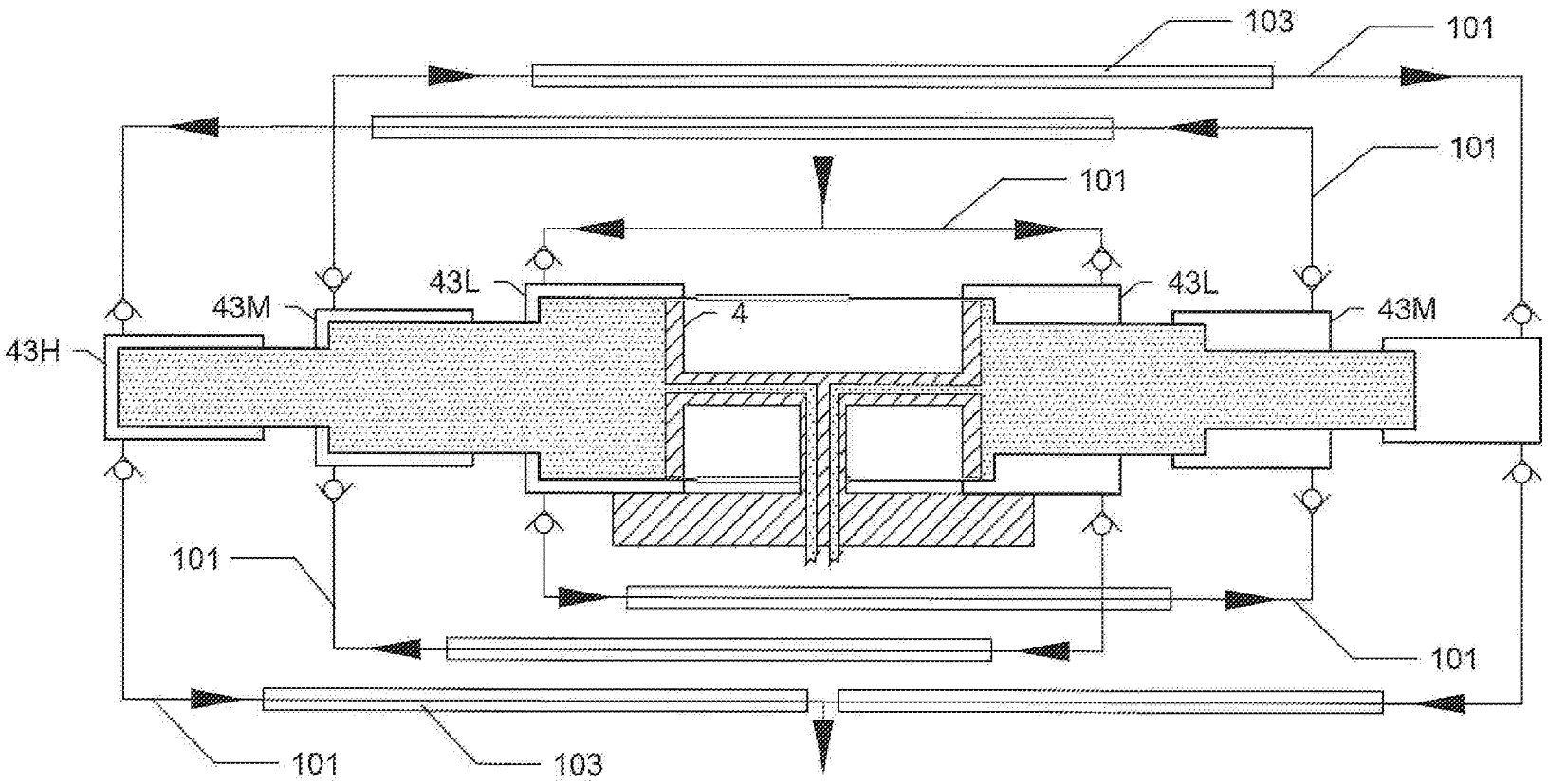
FIG. 5 is a schematic view of the interconnected gas lines between the stages of the compressor of FIGS. 2A and 2B.

As in the embodiment of FIG. 5, the compressed hydrogen exiting the compressor can be cooled as well. The hydrogen flows through lines 101 which lines are provided with heat exchange fins 103. A cooling medium can be circulated about the finned lines. The side walls of the compression chamber 15 are cooled as well. A cooling jacket is provided around each side wall, through which a cooling medium, flows. The cooling media is passed through a heat exchanger and recirculated.

Figure 2A:
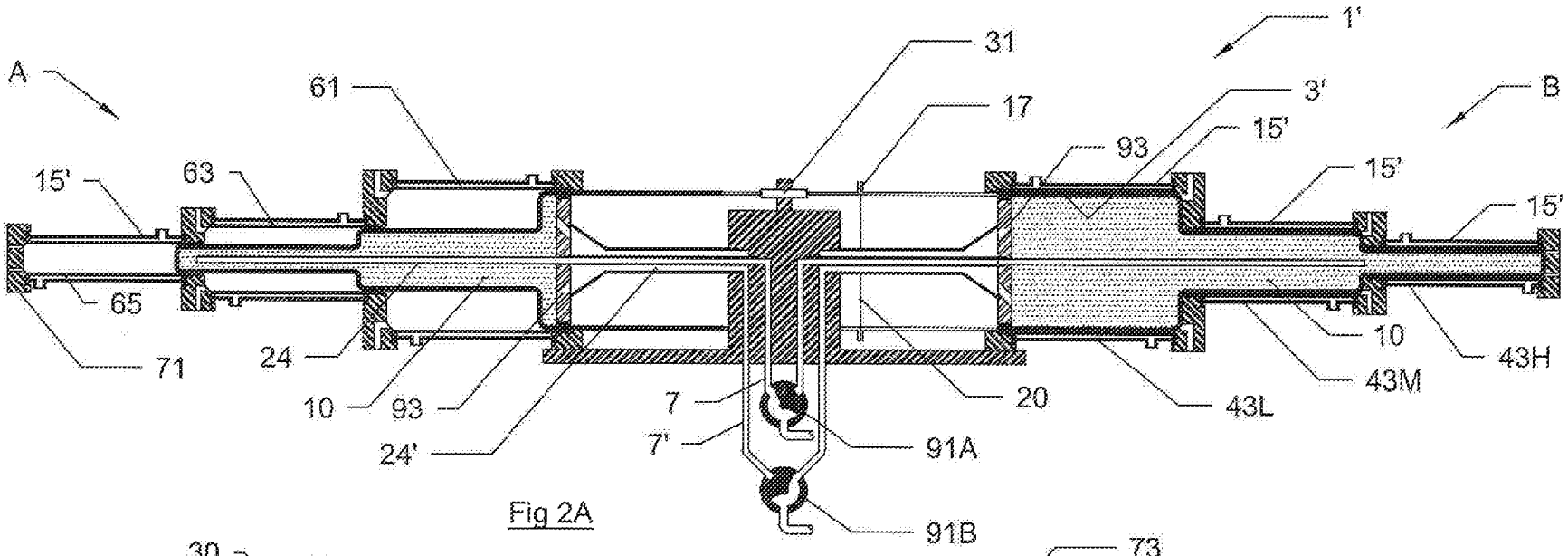
FIGS. 2A and 2B are cross-sectional side views of a multi-stage compressor, shown in various stages of reciprocation.
Figure 2B:
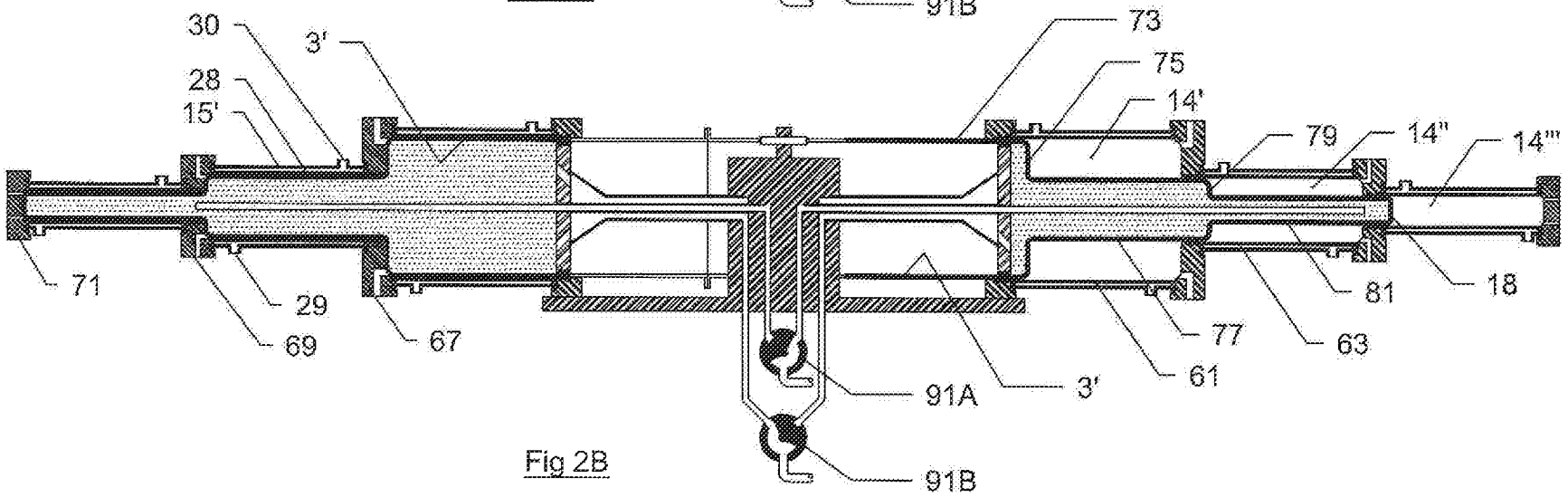

FIGS. 2A and 2B illustrate another embodiment of the compressor 1', namely a multi-stage compressor. The number of stages can vary, for example from 2-5 stages. In the figures shown, the compressor has three stages, namely a low pressure stage 43L, a medium pressure stage 43M and a high pressure stage 43H. Each stage has a compression chamber, which compression chamber is formed by the compression cylinder 15' and the drive cylinder 3'. Each side A, B of the compressor has the three stages.

Each stage of the compression cylinder has a different diameter. The low pressure stage has a side wall 61 with a first inside diameter, the medium pressure stage has a side wall 63 with a second inside diameter and the high pressure stage has a side wall 65 with a third inside diameter. The first inside diameter is larger than the second inside diameter and the third inside diameter, while the second inside diameter is larger than the third inside diameter. The side walls 61, 63, 65 are cylindrical. Annular end plates are provided, with the low pressure stage having a first end plate 67, the medium pressure stage having a second end plate 69 and the high pressure stage having a third end plate 71.

The drive cylinder 3' has a first stage located in the low pressure stage and forming a first compression chamber 14'. The first stage has a first side wall 73 with a first outside diameter, an end wall 75 and a second side wall 77 with a second outside diameter. The second outside diameter is less than the first outside diameter so that the second side wall 77 is received by the medium pressure stage. The first compression chamber 14' is formed by the compression cylinder side wall 61 and end wall 67 and the drive cylinder side walls 73, 77 and end wall 75.

The drive cylinder 3' has a second stage located in the medium pressure stage and forming a second compression chamber 14". The second stage has an end wall 79 and a third side wall 81 with a third outside diameter. The third outside diameter is less than the second outside diameter so that the third side wall 81 is received by the high pressure stage. The second compression chamber 14" is formed by the compression cylinder side wall 63 and end wall 69 and the drive cylinder side wall 81 and end wall 79.

The drive cylinder 3' has a third stage located in the high pressure stage and forming a third compression chamber 14'. The third stage has an end wall 18. The third compression chamber 14' is formed by the compression cylinder side wall 65 and end wall 71 and the drive cylinder side wall 81 and end wall 18.

On each side A, B, the respective drive cylinder 3' has a continuous interior chamber 10 that extends from the respective piston 4 through the stages to the end wall 18. The drive fluid is circulated along the length of the interior chamber 10. Each drive cylinder 3' has a tube 24 inside the interior chamber that extends from the fluid passage 7 in the respective piston 4. The tube extends to near the end wall 18 when the drive cylinder is fully retracted back to the piston 4. The piston also has one or more openings 93 that communicate with another passage 7' by means of an annular space 24'. One of the fluid passages connects to one of the fluid control valves 91A, while the other fluid passage connects to the other fluid control valve 91B.

Each of the compression cylinders also have an inlet 51 and an outlet 53 for each compression stage.

In operation, as shown in FIG. 2A, valve 91B is the inlet selection device in the side B position and valve 91A is the outlet selection device in the side A position. In this configuration, drive fluid 12 from the pump enters the passage 7', passes through annular space 24', the openings 93 and into the interior chamber 10 of side B. The drive cylinder on side B moves away from the piston to compress gas in each compression chamber 14', 14", 14' on side B. FIG. 2A shows the drive cylinder on side B at the end of its compression stroke. The valves are then changed with valve 91B changing to the Side A position (see FIG. 2B). Hot drive fluid 12 exits the drive cylinder through tube 24 in the piston and into passage 7' and on to the heat exchanger 16. The drive fluid 12 inside the drive cylinder 3' thus circulates from the end to the piston, thereby minimizing stagnant volumes of drive fluid and thus hot spots inside the drive cylinder. FIG. 2B shows the drive cylinder on side B at the end of its retraction stroke. The two valves 91A, 9B operate conversely to each other, with one valve in communication with the chamber 10 of one side and the other in communication with the chamber 10 of the opposite side.

In FIGS. 2A and 2B, compression cylinder 15 has cooling jackets 28 around each of its stages, with a cooling jacket coolant inlet 29 and a cooling jacket coolant outlet 30. Each cooling jacket 28 can have coolant circulated through it to remove heat from the outer sides of the compression chambers 14', 14", 14'. Alternatively, a single cooling jacket can be used for all the stages on a side.

Each drive cylinder 3' is a symmetrical, segmented, unitized element with a smooth sealing surface 19 on either side of a means of connection 17 located at the midpoint 20 between the two furthest compression stage face 18. The gas retention seal 21 of each compression cylinder is fixed to the internal surface of the compression drive wall, against the surface of the reciprocating compression piston. This configuration minimizes the machining steps required to fabricate and the difficulty to surface the compression piston. This piston can also be made with a thin wall dimension due to the opposition of forces on both sides of its sidewall during operation. This thin side wall improves on the rate of heat transfer from the compression side 22 to the drive-fluid side 23.

Figure 6A:
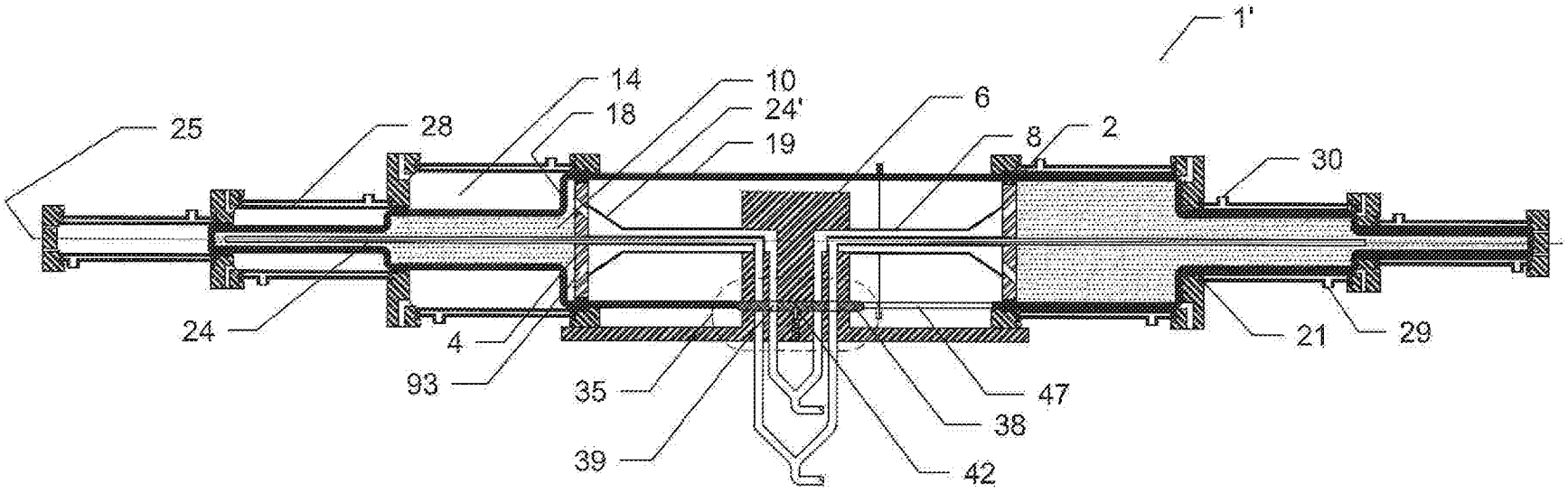
FIGS. 6A and 6B are cross-sectional side views of a multi-stage compressor, in accordance with another embodiment.
Figure 6B:
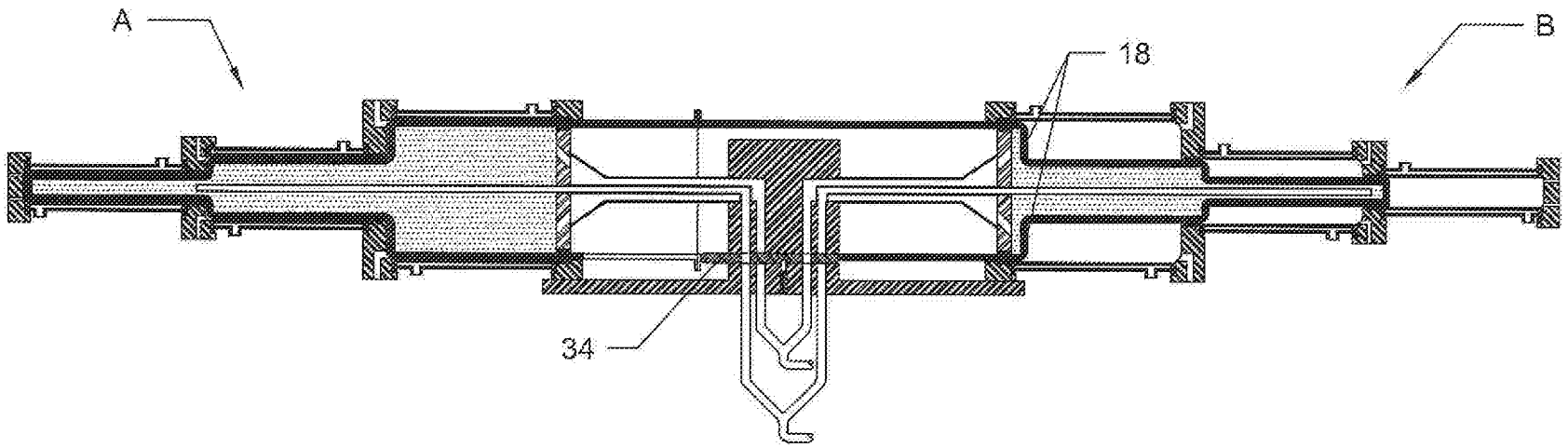

FIGS. 6A and 6B show another embodiment of the compressor. The compressor has multiple stages and is similar to that of FIGS. 2A and 2B. The controller and fluid control valves is different, being mechanically actuated. The support block 6 is configured with a sliding-stem type valve 35, the stem of which partially extends beyond the outside dimension of the hydraulic drive piston support block 6 parallel to the compressor longitudinal axis 25. The valve sliding stem 38 has valve stem openings 39 through it that align with fluid passages 7, 7'. As one of the drive cylinders 3 reaches terminal distance of stroke, the extended portion of the valve sliding stem 38 is engaged by a profile edge of the compression drive slot opening 47, proximate to the support block 6, where valve sliding stem 38 is propelled to its alternate position 34, drawn to precise location by the valve sliding stem positioner 42 thereby redirecting the drive fluid flow to and from the respective compression drive hollow interior chambers 10. By this mechanism, the rate of reciprocation of the compressor is determined by the feed rate of the drive fluid 12.

For example, the side A drive cylinder moves the stem toward side B when the drive cylinder is retracted to the respective piston. Conversely, the side B drive cylinder moves the stem toward side A when the drive cylinder is retracted to the respective piston. As the stem reciprocates in the support block, it opens and closes the passages 7, 7' to reciprocate the drive cylinders 3'.

FIG. 5 shows the flow arrangement of compressed hydrogen in a multi-stage compressor, such as shown in FIGS. 2A, 2B and 3. Hydrogen enters each low pressure stage. The hydrogen on side A exits the low pressure stage and enters the medium pressure stage on side B. The hydrogen on side A exits the medium pressure stage and enters the high pressure stage on side B. Likewise, in the reciprocal direction, the hydrogen on side B exits the low pressure stage and enters the medium pressure stage on side A. The hydrogen on side B exits the medium pressure stage and enters the high pressure stage on side A. The hydrogen exits the high pressure stages to storage.

FIG. 5 shows the use of plural multiple one-way valves in a single line. For example, the outlet line of the low pressure stage 43L on one side is connected to the inlet of the medium stage 43M on the other side. This line is shown as having two one-way valves. The line could be provided with a single one-way valve. Each line has at least one one-way valve, but it could have more than one valve.

This arrangement adds to the overall efficiency as it uses the compressed gas to assist in recovering the drive cylinder to the retracted position. For example, the compressed gas from the low pressure stage of side A flows into the medium pressure stage of side B. The drive cylinder of side A is moving to the extended position to compress the gas. The compressed gas from side A flows into side B to assist in moving the drive cylinder to the retracted position.

The compressor, the pump and the heat exchanger can be located remote from one another to allow the compressor to operate in a submerged environment or an explosive environment.

The foregoing disclosure and showings made in the drawings are merely illustrative of the principles of this invention and are not to be interpreted in a limiting sense.

The invention claimed is:

1. An internally cooled inline compressor, comprising:

a) A drive cylinder comprising first and second intermediate cylinders;

b) Fixed first and second pistons, each with a channel therethrough;

c) A first fixed outer cylinder with a gas inlet and a gas outlet, each of the gas inlet and the gas outlet having at least one one-way valve;

d) A second fixed outer cylinder with a gas inlet and a gas outlet, each of the gas inlet and the gas outlet having at least one one-way valve, the second outer cylinder coupled with the first outer cylinder;

e) Drive fluid;

f) The first intermediate cylinder having a closed compression end and a side wall, the first intermediate cylinder compression end and a portion of the first intermediate cylinder side wall located between the first piston and the first outer cylinder, the compression end and the side wall of the first intermediate cylinder, a side wall of the first outer cylinder, and an end wall of the first outer cylinder forming a first compression chamber, the compression end and the side wall of the first intermediate cylinder and the first piston forming a first drive chamber, the first drive chamber communicating with the first piston channel, the first intermediate cylinder capable of reciprocating between the first piston and the first outer cylinder;

g) The second intermediate cylinder being coupled to the first intermediate cylinder, the second intermediate cylinder having a closed compression end and a side wall, the second intermediate cylinder compression end and a portion of the second intermediate cylinder side wall located between the second piston and the second outer cylinder, the compression end and the side wall of the second intermediate cylinder, a side wall of the second outer cylinder, and an end wall of the second outer cylinder forming a second compression chamber, the compression end and the side wall of the second intermediate cylinder and the second piston forming a second drive chamber, the second drive chamber communicating with the second piston channel, the second intermediate cylinder capable of reciprocating between the second piston and the second outer cylinder;

h) The first and second compression chambers each comprising first and second stages;

i) The first outer cylinder having a first inside diameter in the first stage of the first compression chamber and a second inside diameter in the second stage of the first compression chamber, the first inside diameter being larger than the second inside diameter, the first intermediate cylinder having a first outside diameter in the first stage of the first compression chamber and a second outside diameter in the second stage of the first compression chamber, the first outside diameter being larger than the second outside diameter;

j) The second outer cylinder having a first inside diameter in the first stage of the second compression chamber and a second inside diameter in the second stage of the second compression chamber, the first inside diameter being larger than the second inside diameter, the second intermediate cylinder having a first outside diameter in the first stage of the second compression chamber and a second outside diameter in the second stage of the second compression chamber, the first outside diameter being larger than the second outside diameter;

k) a first inside seal between the first piston and the first intermediate cylinder in the first drive chamber;

l) a second inside seal between the second piston and the second intermediate cylinder in the second drive chamber;

m) a first outside seal between the first intermediate cylinder and the first outer cylinder in the first compression chamber;

n) a second outside seal between the second intermediate cylinder and the second outer cylinder in the second compression chamber;

o) the first and second outside seals isolated from the drive fluid that is positioned within the respective drive chambers by the respective intermediate cylinders;

p) A power source connected to the channels of the first and second pistons, the power source alternately providing and discharging the drive fluid to the first and second drive chambers to reciprocate the first and second intermediate cylinders;

q) A heat exchanger alternately connected to the channels of the first and second pistons so that the drive fluid that is discharged from the first and second drive chambers passes through the heat exchanger.

2. The internally cooled inline compressor of claim 1, wherein the channel in the first piston is a first channel, further comprising a second channel in the first piston, the first piston first channel having a first opening located at a first position in the first drive chamber, the first piston second channel having a second opening located in the first drive chamber, wherein the drive fluid is configured to be circulated inside the first drive chamber.

3. The internally cooled inline compressor of claim 2, wherein the channel in the second piston is a first channel, further comprising a second channel in the second piston, the second piston first channel having a first opening located at a first position in the second drive chamber, the second piston second channel having a second opening located in the second drive chamber, wherein the drive fluid is configured to be circulated inside the second drive chamber.

4. The internally cooled inline compressor of claim 1, wherein the first and second compression chambers each comprise one or more additional stages.

* * * * *